US007777685B2

(12) United States Patent
Stuart

(10) Patent No.: US 7,777,685 B2
(45) Date of Patent: Aug. 17, 2010

(54) SMALL SPHERICAL ANTENNAS

(75) Inventor: Howard R. Stuart, Glen Ridge, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 587 days.

(21) Appl. No.: 11/540,442

(22) Filed: Sep. 29, 2006

(65) Prior Publication Data

US 2008/0079646 A1 Apr. 3, 2008

(51) Int. Cl.
*H01Q 9/28* (2006.01)

(52) U.S. Cl. ..... 343/795; 343/814; 343/742; 343/867

(58) Field of Classification Search ..... 343/700 MS, 343/795, 741, 742, 866, 867, 810, 797, 814
See application file for complete search history.

(56) References Cited

U.S. PATENT DOCUMENTS 3,307,108 A * 2/1967 Induni ..... 455/128
6,215,455 B1 * 4/2001 D'Angelo et al. ..... 343/842
6,593,895 B2 * 7/2003 Nesic et al. ..... 343/795
6,791,432 B2 * 9/2004 Smith et al. ..... 333/99 S
6,801,173 B2 * 10/2004 Wiltshire ..... 343/787
7,009,565 B2 * 3/2006 Pidwerbetsky et al. ..... 343/700 MS
7,015,865 B2 * 3/2006 Isaacs et al. ..... 343/757
7,205,941 B2 * 4/2007 Wang et al. ..... 343/700 MS
2006/0109540 A1 * 5/2006 Kueks et al. ..... 359/321
2007/0024399 A1 * 2/2007 Antolin et al. ..... 333/205

* cited by examiner

*Primary Examiner*—HoangAnh T Le
(74) *Attorney, Agent, or Firm*—Martin I. Finston

(57) ABSTRACT

An antenna is provided for operating within the electrically small antenna regime (i.e., ka≅0.5), and having bandwidth performance quite close to fundamental limits. The antenna of the invention, in various embodiments, is based upon spherical resonator structures that are characterized by a performance factor ($Q/Q_{chu}$) close to 1.5. The antenna combines a resonator structure determined according to the method of the invention with an appropriate transmission line feeding arrangement, such that the resonator effectively couples the transmission line mode to the radiating spherical harmonic mode in an impedance-matched manner.

19 Claims, 10 Drawing Sheets

SMALL SPHERICAL ANTENNAS

FIELD OF THE INVENTION

The invention relates generally to antennas and particularly to small spherical antennas having improved bandwidth performance.

BACKGROUND OF THE INVENTION

The development of electrically small radio frequency (RF) antenna elements is important for many emerging applications, such as multi-input multi-output (MIMO) mobile communications systems and RF tagging. In the art of small antennas, a useful volumetric parameter is ka, where k is the free space wave number ($k=2\pi/\lambda$, where $\lambda$ is free space wavelength) and a is the radius of the smallest sphere enclosing the antenna. It is well understood that, as the antenna size becomes small (particularly, when $ka<0.5$), the ability of the antenna to radiate effectively is substantially reduced. This fundamental limitation is commonly described in terms of the quality factor, Q, of the antenna—i.e., as antenna size is reduced, Q tends to increase.

In the absence of material or conductor loss, the Q of an antenna element is proportional to the ratio of the energy stored in the antenna to the rate at which the antenna emits radiation. Because the operating bandwidth of an antenna varies inversely with Q, it is desirable to achieve as low a Q as possible when designing a small antenna for a specific application. However, as noted, small antenna elements are typically characterized by large values of Q, due to the fact that they are not effective radiators.

A fundamental relationship between antenna size and Q has been formulated by L. J. Chu ("Physical Limitations On Omni-directional Antennas," *J. Appl. Phys*, vol. 19, pp 1163-1175; 1948), which relationship is referred to herein (and in the art) as the Chu limit. That Chu limit specifies the minimum Q achievable for an antenna of size ka. Based on the teaching of Chu, the Q of an antenna (or equivalently, the Q of any self-resonant object with a single electric or magnetic dipole resonance) has been shown to obey the relationship $$Q \geq \frac{1}{(ka)^3} + \frac{1}{(ka)}.$$

From this relationship it can be seen, as noted above, that decreasing the size of the resonator increases its Q and narrows its bandwidth. Of all of the problems typically encountered when designing small antennas (e.g., narrow bandwidth, impedance matching to low radiation resistance, low efficiency), the ability to design an antenna whose performance achieves low Q (high bandwidth) approaching the Chu limit is the most challenging to solve.

In the current art, very few single resonance antenna designs exist that closely approach the Chu limit. In general, however, it is well understood that performance close to the Chu limit can be achieved using antennas that make optimal use of the spherical volume encompassing the antenna. A known example of such an antenna is the spherical helix antenna, which consists of a helix structure wound into the shape of a sphere. Such a spherical helix antenna is capable of achieving Q-factors of 1.5 times the Chu limit at high efficiencies. At the same time, the complexity of the spherical helix antenna equates to high production cost, particularly at frequencies in the range of one to several GHz, where the antenna diameter is on the order of centimeters and antennas compatible with printed circuit board manufacturing techniques are preferred.

It is also known to achieve antenna Q factors that closely approach the Chu limit through the use of multiple resonance structures—e.g., the Goubau antenna, the disk loaded monopole, and the folded conical helix antenna. In principle, however, antennas based upon multiple resonances are capable of impedance matching bandwidths exceeding that achieved in single resonance antennas operating near the Chu limit. Therefore, such multiple resonance antennas do not represent optimized solutions.

SUMMARY OF THE INVENTION

A new antenna, and method for fabricating the antenna, is provided for operating within the electrically small antenna regime (i.e., $ka \cong 0.5$), and having bandwidth performance quite close to fundamental limits. The antenna of the invention, in various embodiments, is based upon spherical resonator structures that are characterized by a performance factor close to 1.5, that performance factor being identified herein as a Chu factor, defined as $Q/Q_{chu}$, (where Q is the Q-factor of the resonator, and $Q_{chu}$, is the lower limit on Q-factor as specified by the Chu limit). The antenna combines a resonator structure determined according to the method of the invention with an appropriate transmission line feeding arrangement, such that the resonator effectively couples the transmission line mode to the radiating spherical harmonic mode in an impedance-matched manner.

According to the invention, a single resonator is formed by a patterned array of conductors, combined in such a way as to create a resonating spherical object, and wherein the individual conductor patterns need not be electrically connected to one another. In an exemplary embodiment, the resonator can be constructed using an array of non-interconnected printed circuit boards (PCBs). A resonator/antenna so constructed behaves electromagnetically as a sphere, but can be fabricated using purely planar building blocks. Antennas based the methodology of the invention are therefore easier to construct than the spherical helix antenna of the art, especially at higher frequencies where the physical size of the antenna becomes quite small.

In an alternative embodiment of this invention, the resonator structure can be made to assume shapes other than spherical. Although the spherical shape is optimal, for bandwidth maximization, some antenna applications may place practical restrictions upon the aspect ratio or shape of the antenna. Accordingly, providing a resonator shape other than spherical, according to the invention, may be useful for some applications, in spite of the bandwidth reductions that result. The methodological principals of the invention can, in any event be applied towards antenna designs that optimize bandwidth performance within the context of aspect ratio or shape constraints.

A still further embodiment of this invention utilizes multiple resonance structures to achieve bandwidth performance beyond what can be achieved in a single resonance structure. The methodology of the invention provides an optimized solution for the single resonance antenna case. By using that optimized single resonance case as a starting point, multiple resonance antennas can be constructed that have bandwidth performance potentially exceeding that achieved in the single resonance antenna operating near the Chu limit.

DETAILED DESCRIPTION OF THE INVENTION

The invention disclosed herein is directed to an antenna structure operative within electrically small antenna constraints (i.e., ka≅0.5), and having bandwidth performance close to fundamental limits, and a methodology for fabricating such an antenna. The antenna of the invention comprises a plurality of planar resonators formed into a three-dimensional structure as described herein. When formed into three-dimensional structures approximating a spherical shape, the resonators achieve radiation Q-factors that are close to the theoretical Chu limit.

Figure 1:
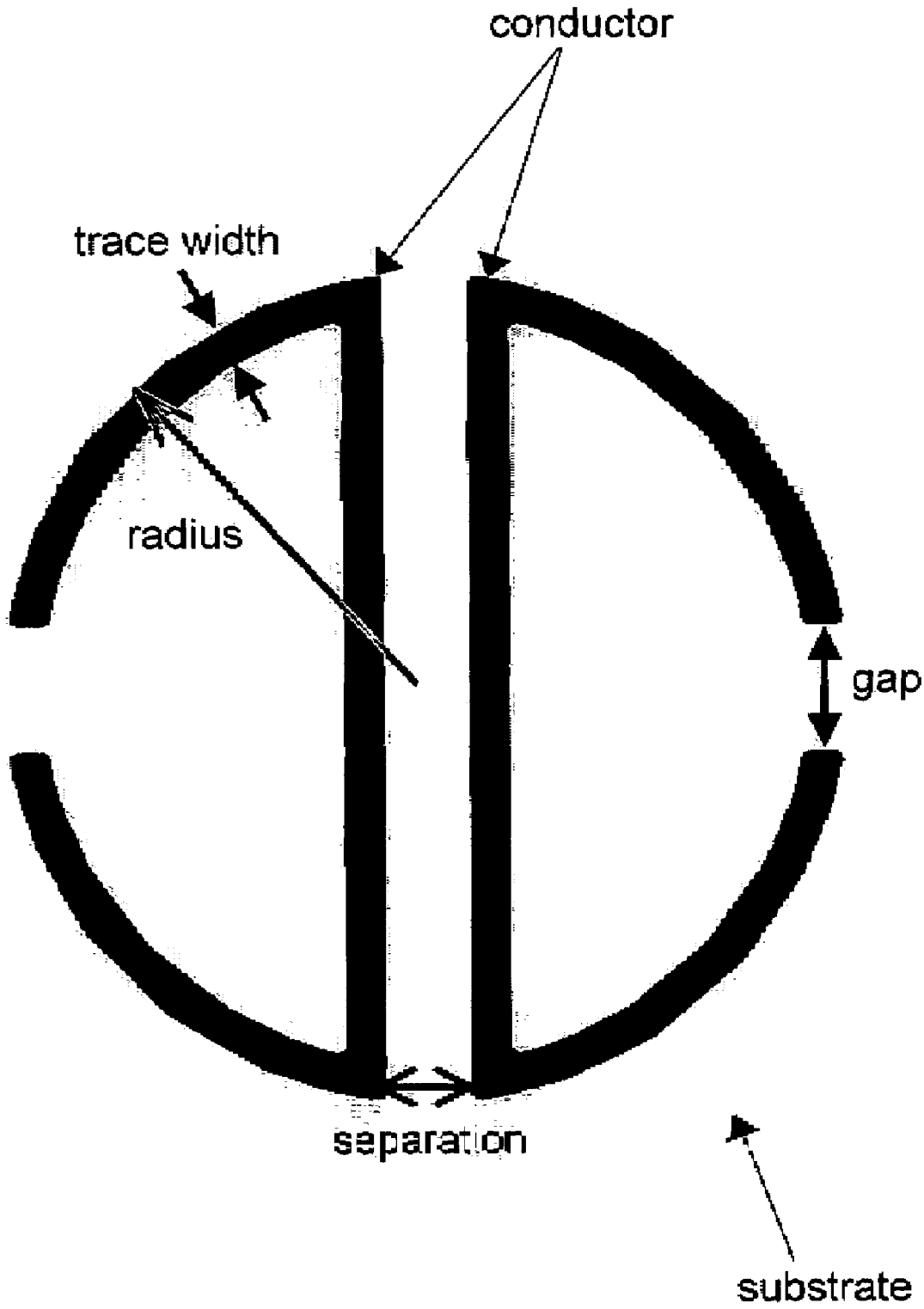
FIG. 1 provides a schematic depiction a basic resonator embodiment of the invention.

The basic planar resonator structure of the invention is a two-arm split-ring structure which is schematically depicted in FIG. 1. This planar resonator structure has two resonant frequencies, one characterized by a magnetic dipole moment and a relatively high Q-factor, and one characterized by an electric dipole moment, and a relatively low Q-factor. As will be seen in the figure, the basic resonator of the invention comprises two juxtaposed conductor patterns, each pattern including a defined gap and the conductors thereof having a defined trace width. As discussed further below in conjunction with the simulation and experimental results curves shown in FIGS. 3 and 4, the resonant frequencies are determined by numerical analysis using standard electromagnetic numerical simulation techniques, e.g. the finite element method. Qualitatively, the resonance frequencies vary with the ring radius, and the inductances and capacitances present in the structure. For example, the inductance can be increased by reducing the trace width and the capacitance can be increased by reducing the gap size.

In the figure, the conductor traces are shown in black and the gray area represents a substrate holding the conductor patterns for the illustrated embodiment. Note, however, that the substrate is not necessary for operation of the resonator of the invention, and, in embodiments for low-frequency antennas (where the physical size of the antenna becomes large) would not likely be present. It is also to be noted that the semi-circular shape of the illustrated resonator arrays is chosen to make a spherical antenna. However, while it is generally true that a spherical antenna will come closest to the Chu limit, the inventive concept can be applied for non-spheres where warranted.

Figure 2:
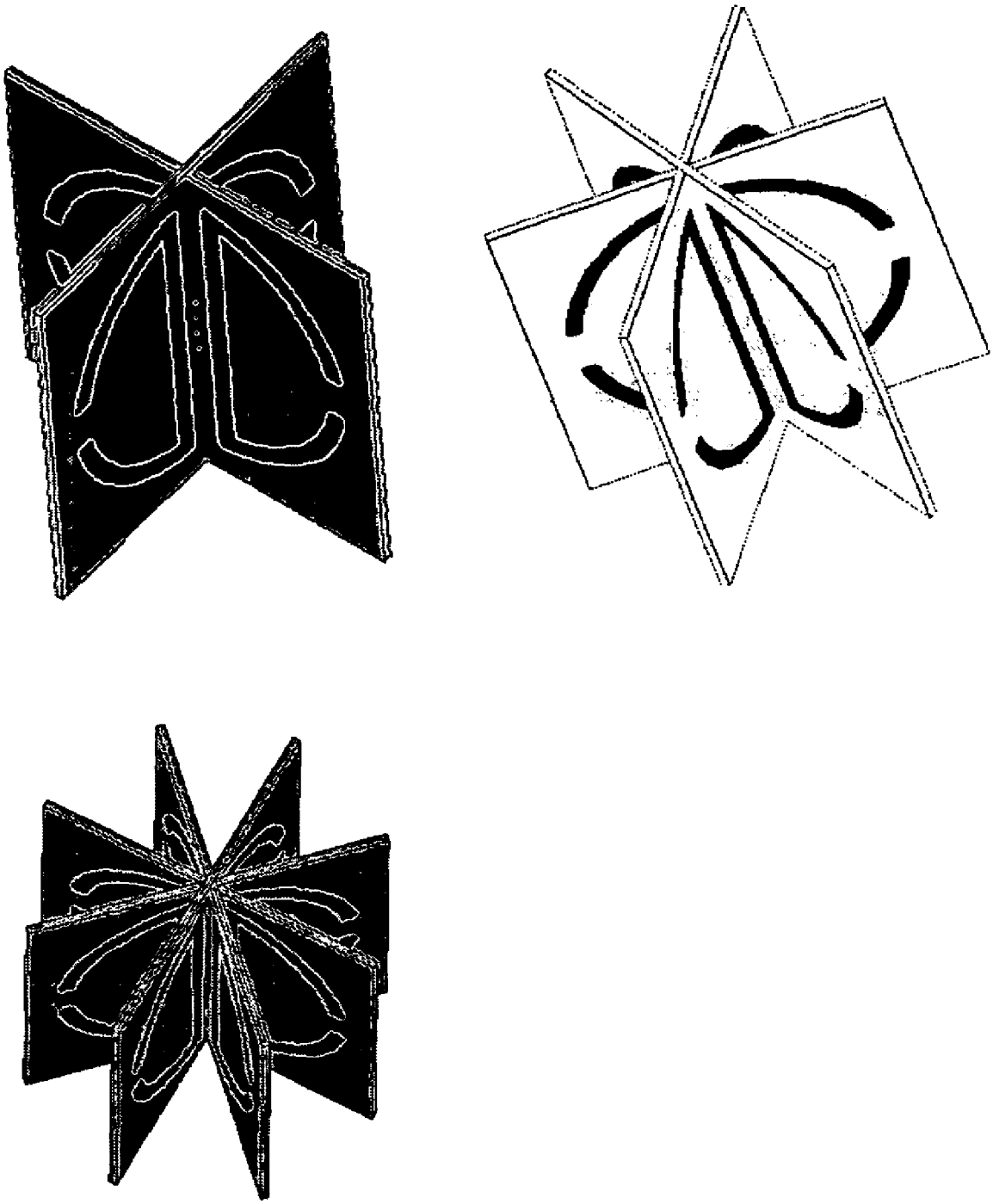
FIG. 2 provides a schematic depiction of more complex resonator embodiments of the invention.

According to the method of the invention, as described more fully hereafter, multiple versions of this resonator can be combined in an axially symmetric manner to produce numerous spherical resonator variations. Four, six and eight-arm such variations are illustrated in FIG. 2, with the same convention as for FIG. 1 to distinguish the conductor paths from the substrate. Note that, as with the basic resonator structure of FIG. 1, the individual conductor patterns need not be electrically connected to one another in the multiple-arm resonator structures of FIG. 2.

It should be understood, however, in respect to FIG. 2, that the variations are not limited to those shown in the figure, and could also include, for example, variations with odd numbers of resonator arms.

The resonant frequencies of the resonator are determined by the various parameters that define the structure: the radius of the rings, the width of the conductor traces, the separation between the conductors along the central axis, the gaps at the outer edge of the rings, the dielectric constant of the substrate, etc. The design of a resonator to achieve a desired resonant frequency can be accomplished using standard numerical simulation techniques in electromagnetics, for example using the finite element method. Guidelines for changing the resonant frequency are readily deduced from a basic knowledge of electromagnetic behavior. For example, increasing the ring radius will result in lower values of the resonant frequency. Alternatively, for a fixed value of ring radius, the resonant frequency can be shifted to lower values by increasing either the capacitance (by decreasing the gap size) or the inductance (by decreasing the trace width) present in the structure. Varying the resonant frequency while holding the ring radius constant is equivalent to varying the normalized size ka of the resonator.

Figure 3:
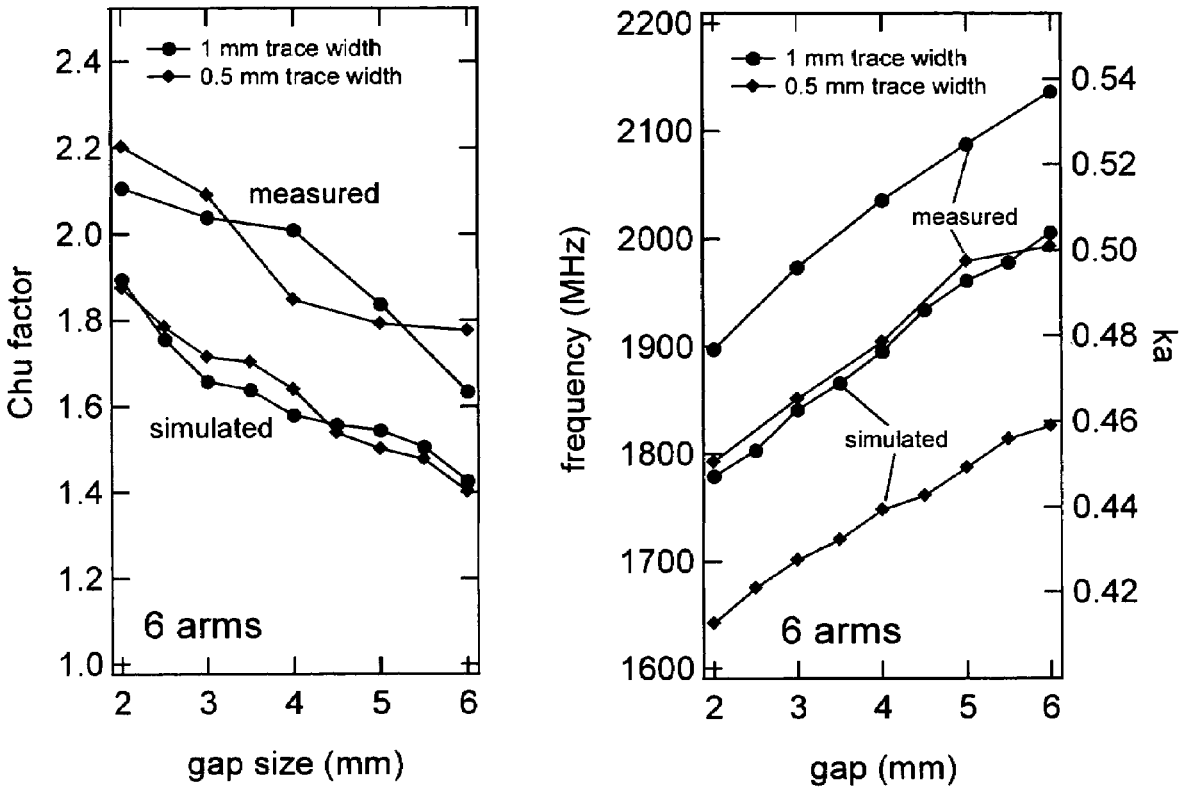
FIG. 3 depicts measured and simulated performance factors for an embodiment of the invention.

The resonator designs illustrated in FIGS. 1 and 2 have been determined by the inventor to be capable of bandwidth performance very close to theoretical limits. To illustrate this capability, simulation and experimental results obtained by the inventor are provided in FIGS. 3 and 4. For the tested/simulated embodiment, the resonators have a radius of 12 mm and are formed using substrates with a dielectric constant of 3.38 and a thickness of 20 mils. Two trace widths were tested/simulated: 1 mm and 0.5 mm. FIG. 3 shows the Chu factor (left graph) and resonant frequency (right graph) for the six arm resonators illustrated in FIG. 2. The simulations were performed using the known finite element method. The experimental test measurements were obtained from scattering measurements of fabricated resonator structures conducted in a microwave anechoic chamber. In both the simulations and the experiments, the resonant frequency and Q-factor of the resonators are determined. Curves marked with diamonds correspond to the 0.5 mm trace width and curves marked with circles correspond to the 1.0 mm trace width. The curve pairs corresponding to measured and to simulated results are as marked in the figure.

Using the resonant frequency and the actual physical size of the resonators, one can deduce the normalized frequency, or size, of the resonators, ka. Using ka as so determined, the Chu limit $Q_{chu}$, for the resonators can be determined. A performance factor for the resonator, designated by the inventor as a Chu factor, is then derived as the ratio of the measured/simulated values of Q to the Chu limit.

The Chu factor is an important figure of merit for the resonators, as it determines how close the realized Q of the resonator is to the theoretical limit in performance. For a resonator with 100% efficiency, the Chu factor cannot be less than 1, and values close to ≈1.5 are expected to represent a practical lower limit. By varying the gap size in the resonators, the inventor has been able to find values that result in measured Chu factors close to 1.6 (illustrated by measured results curves in FIG. 3).

Figure 4:
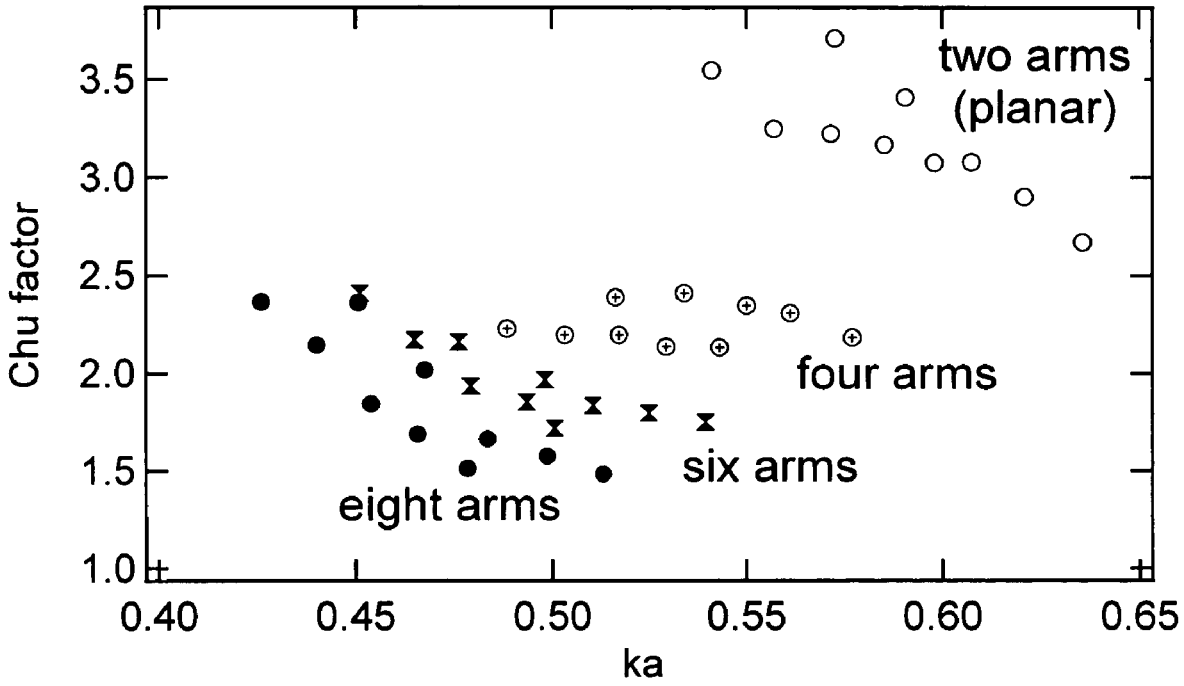
FIG. 4 depicts comparative measured performance results for different embodiments of the invention.

As noted, the curves in FIG. 3 summarize the results of studies (both experimental and simulation) of the six-arm resonators. In FIG. 4, measured Chu factor data versus normalized size, ka, is plotted for the two-, four-, six-, and eight-arm resonators of the invention. In this graph, the two measured quantities (resonant frequency and Q-factor, which are normalized to ka and Chu-factor, respectively) are combined into a single scatter plot showing Chu factor vs. ka. For each resonator, the parameters were varied in a manner similar to that shown in FIG. 3: the trace width was set to one of two values (0.5 mm and 1 mm), and for each trace width, a range of five gap sizes were fabricated, resulting in a total of 10 design variations for each resonator, and a total of 40 resonators. The physical size of the resonators was held constant at 12 mm, but the normalized size ka varies because the resonant frequency is different for each design variation.

By plotting Chu-factor vs. ka, one can see immediately the significance of the inventive concept. Recall, initially, the general theoretical guidance above regarding resonant frequency, corresponding here to ka—i.e., resonant frequency can be shifted to lower values by increasing either the capacitance (by decreasing the gap size) or the inductance (by decreasing the trace width). Within a particular resonator configuration (take, for example, the two-arm configuration), smaller values of ka can be achieved (by reducing the gap size), but this results in higher Chu factors. Thus, for the planar two-arm configuration, moving toward lower ka (smaller size) results in increasingly poor performance—i.e., Chu factor increases as one tries to make the antenna size smaller (the curve moves towards the upper left of the graph). However, in going from the planar resonator to the volumetric resonators, one moves towards the lower left of the plot, i.e. smaller values of ka can be achieved and lower Chu factors can also be achieved. As can be seen from the figure, moving from the planar resonator to the four-arm spherical resonator results in a dramatic bandwidth improvement. Adding more arms to the spherical resonators improves the performance further. A Chu factor of 1.5 is measured in the eight-arm resonator for ka=0.5, indicating that these resonators have bandwidth performance very close to the theoretical limits.

Figure 5:
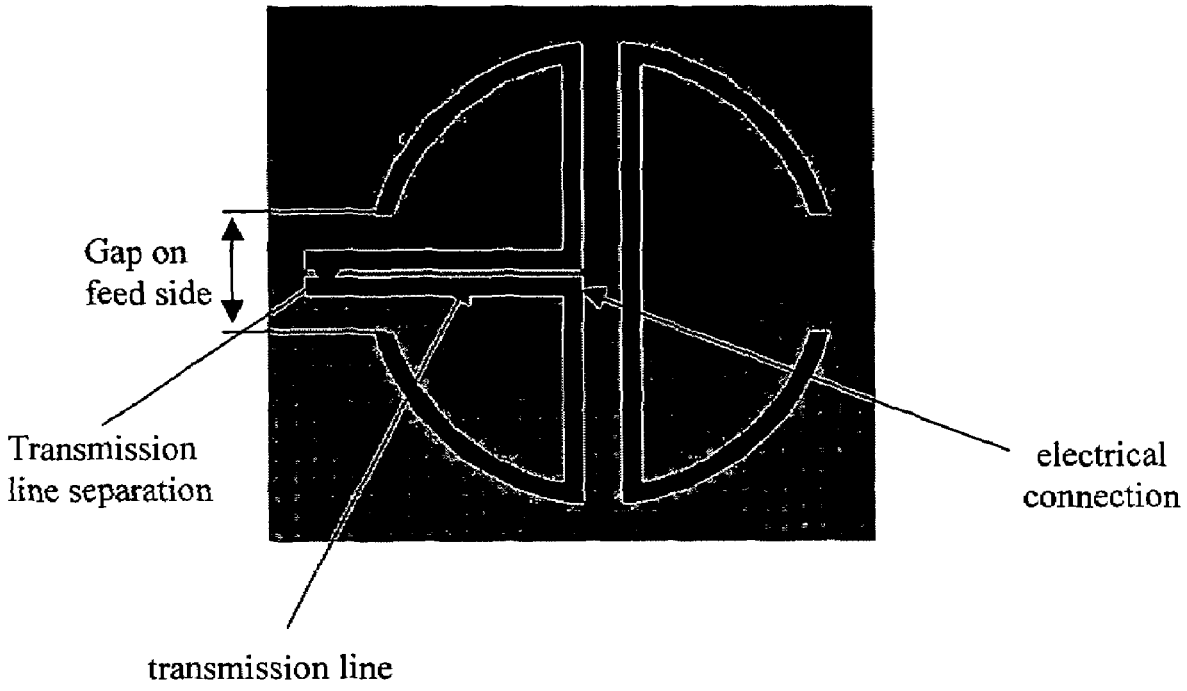
FIG. 5 provides a schematic depiction of a basic antenna embodiment of the invention.

To form antennas from the resonators of the invention, an impedance-matched transmission line is required to feed to the resonators. To illustrate that aspect of the invention, an example of a planar antenna based upon the two-arm resonator is described below. It is noted that this exemplary antenna was built and tested by the inventor. As discussed herein, the test results confirm the effectiveness of the transmission line feed geometry and demonstrate that the resulting antenna has a bandwidth that corresponds to the measured resonator characteristics shown in FIG. 4. The exemplary antenna was designed to be driven by a balanced 100 ohm coplanar strip transmission line (with no ground plane). In order to drive the antenna, the transmission line is fed to near the center of the resonator structure, and brought into electrical contact with one of the arms of the resonator, as illustrated in FIG. 5. The value of the feed gap (the gap size at the point where the transmission line enters the resonator) can be varied in order to obtain a good impedance match. It is to be noted that the transmission line does not need to be electrically connected to both arms of the resonator in order to produce a good impedance match. This is attributable to the fact that the transmission line mode excites the resonant mode of the entire resonator structure (which includes both split rings)—which has been confirmed by design simulations showing that currents are induced effectively in both arms of resonator.

Figure 6A:
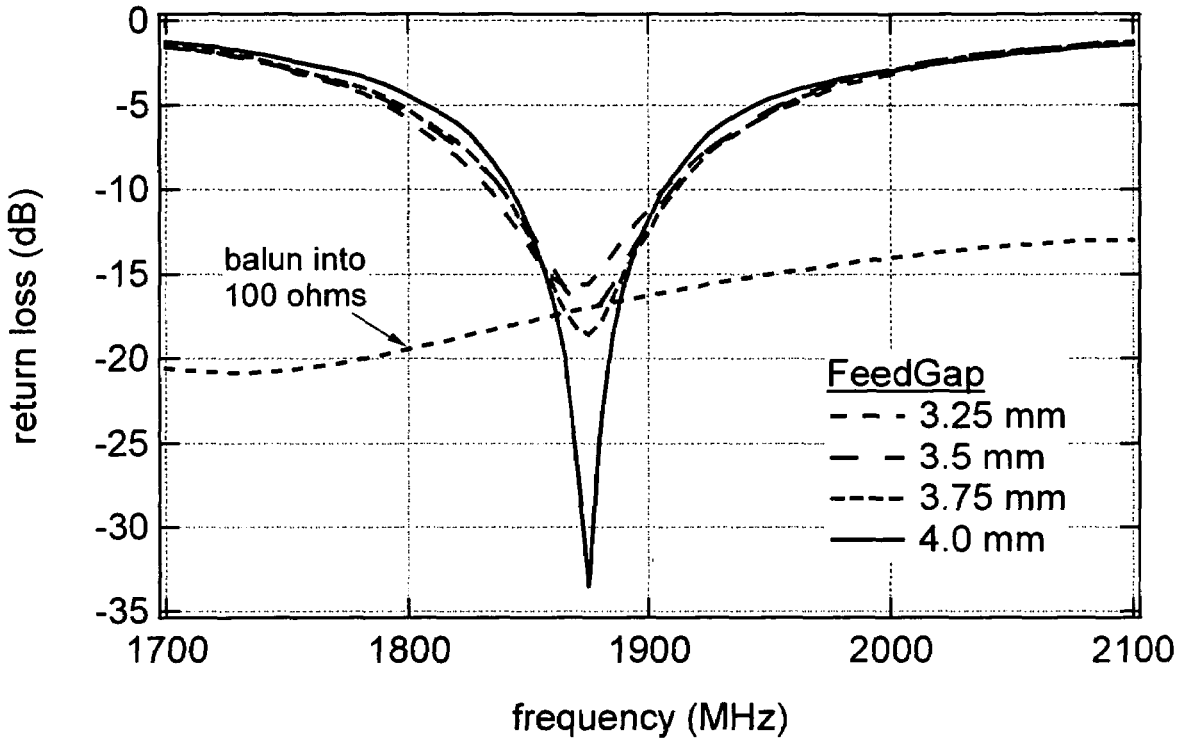
FIG. 6A depicts measured performance results for the antenna embodiment of FIG. 5.
Figure 6B:
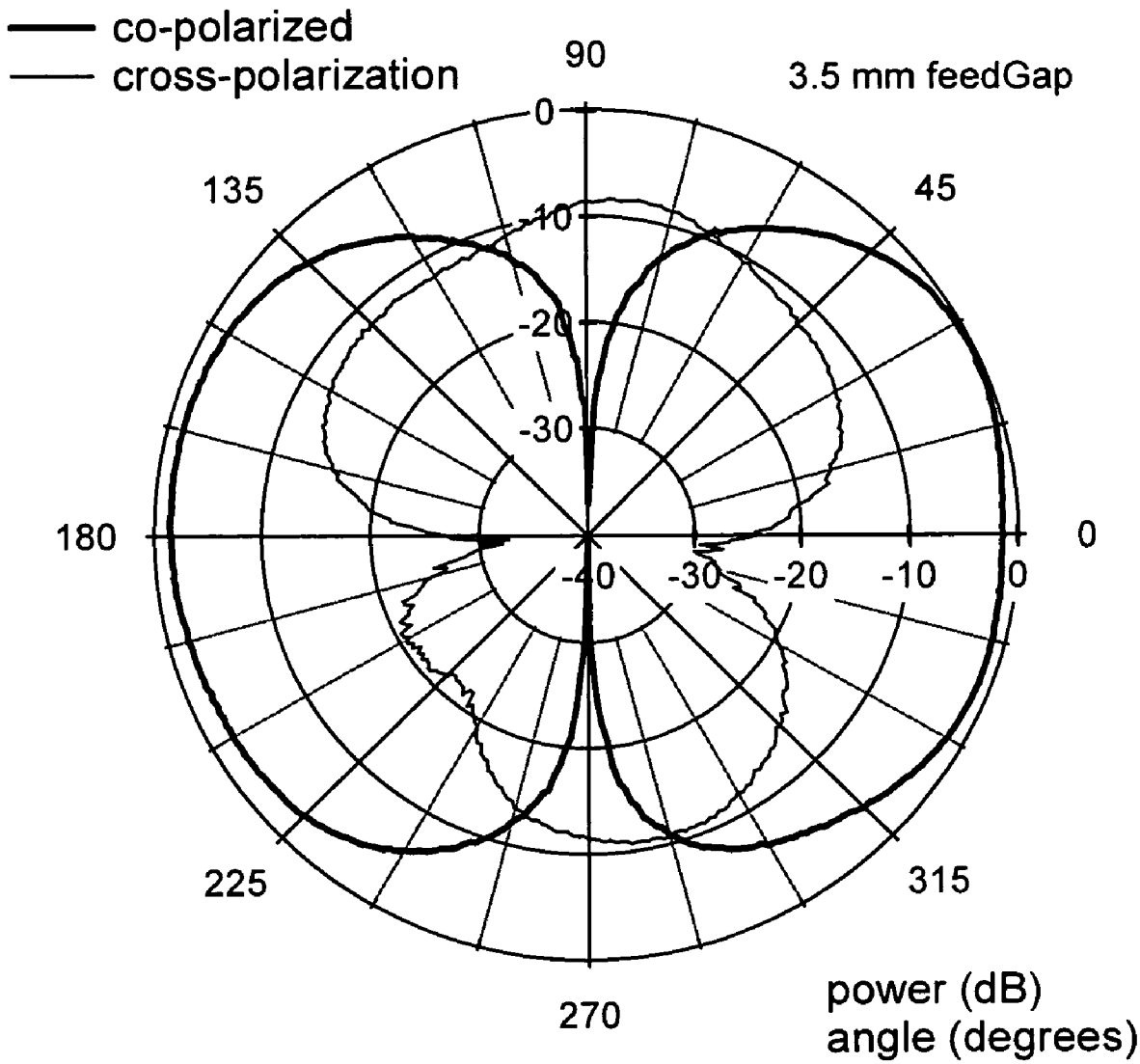
FIG. 6B depicts a radiation pattern for the antenna embodiment of FIG. 5.

For testing purposes, a balun was used to interface the balanced transmission line with an unbalanced 50 ohm coaxial cable and test equipment. The measured performance for the exemplary antenna embodiment is depicted in the graph of Return Loss vs. Frequency shown in FIG. 6A. The radiation pattern of the exemplary antenna embodiment is that of a small electric dipole, which is expected for an antenna of this size. That radiation pattern is illustrated in FIG. 6B.

The performance of the exemplary antenna embodiment above corresponds very well to performance predicted in design simulations. The Q-factor of the antenna can be determined from the derivative of the measured antenna impedance Z at the resonant frequency using the following formula (derived in A. D. Yaghjian and S. R. Best, "Impedance, bandwidth, and Q of antennas," *IEEE Trans. Ant. Prop.*, vol. 53, pp. 1298, 2005):

$$Q \approx \frac{\omega_0}{2R_0}|Z'(\omega_0)|$$

where $\omega_0$ is the resonant frequency and $R_0$ is the transmission line impedance at the resonant frequency. The Q-factor of the measured antenna corresponds to a Chu factor of 3.1 at ka=0.57, consistent with the performance expected from the performance measurements for the two-arm resonator embodiment shown in FIG. 4. The antenna efficiency for the described exemplary antenna embodiment has also been measured (using the Wheeler cap method) to be ~93% (including loss in the balun), indicating that the efficiency of the antenna is indeed very high.

Figure 7A:
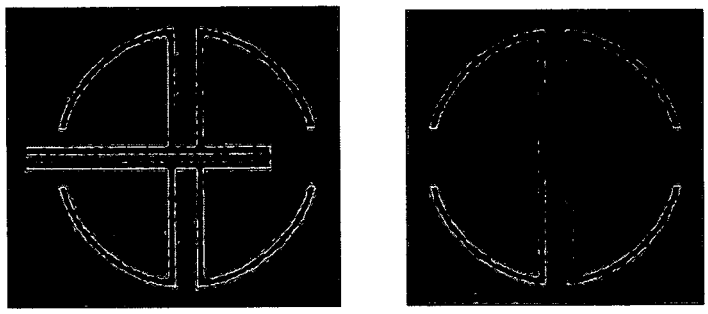
FIG. 7A provides a schematic depiction of the planar components of a volumetric antenna embodiment of the invention.
Figure 7B:
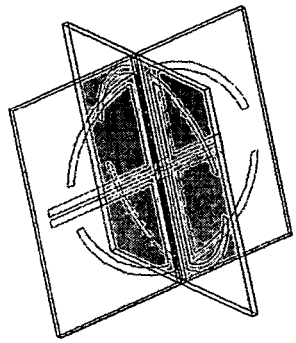
FIG. 7B schematically depicts the volumetric antenna embodiment of the invention as assembled from the planar components illustrated in FIG. 7*a*.

As can readily be deduced from the resonator performance results shown in FIG. 4, the planar antenna embodiment described above will be more narrow in bandwidth as compared with antennas based upon the volumetric resonator embodiments heretofore described, and also having performance results depicted there. To achieve the improved performance associated with those volumetric resonator embodiments, antennas may also be formed according to the invention from those volumetric resonator embodiments. As an exemplary case of such volumetric antenna embodiments, a four-arm volumetric spherical antenna embodiment is described below and schematically illustrated in FIGS. 7A and 7B—FIG. 7A illustrating the planar components of the volumetric antenna embodiment and FIG. 7B illustrating the assembled antenna.

The volumetric antenna embodiment of FIG. 7 is again designed to be driven by a balanced 100 ohm coplanar transmission line (no ground plane). In this embodiment, the transmission line drive is connected to the two split-rings that are coplanar with the transmission line (as illustrated in FIG. 7*a*), but the orthogonal plane (containing the other two split-ring arms) is not electrically connected to the transmission line. The impedance matching is further assisted by a small shorted stub that extends slightly beyond the interface with the second split ring.

Figure 8A:
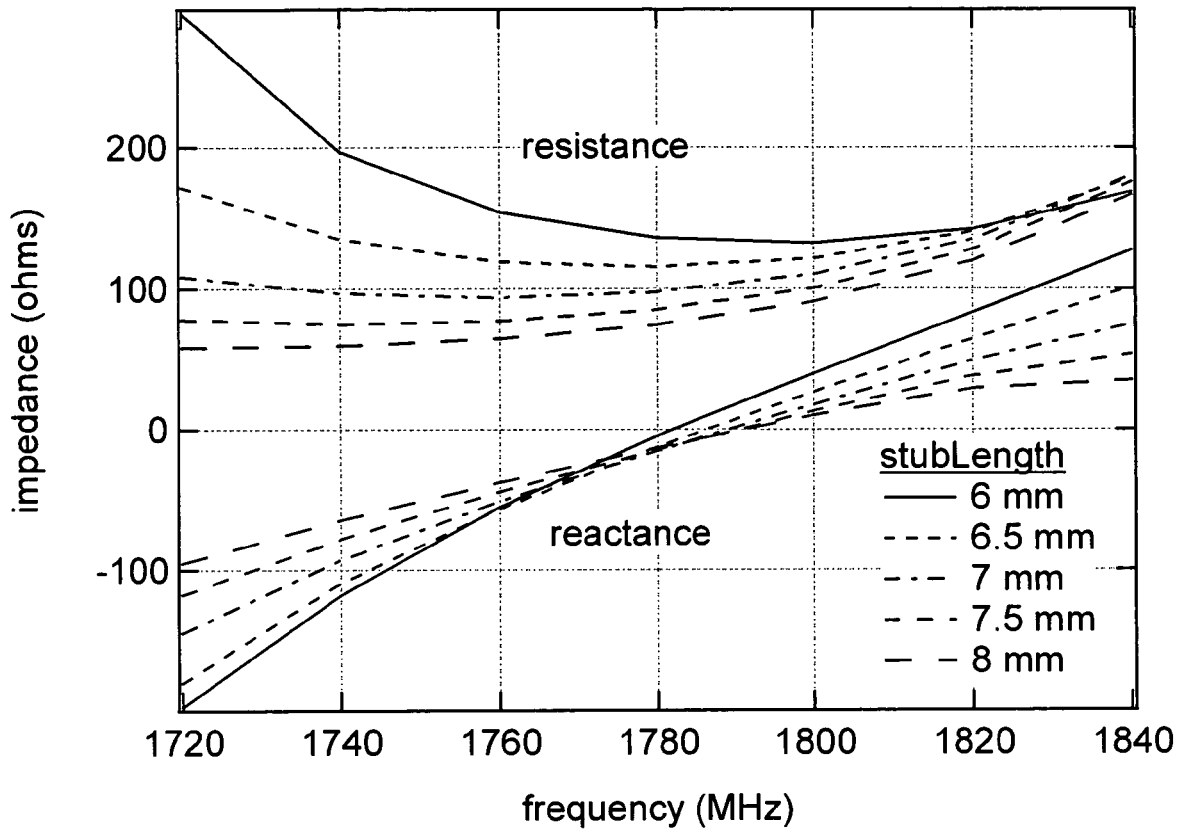
FIG. 8A provides a graph of impedance vs. frequency for the volumetric antenna embodiment of FIG. 7.
Figure 8B:
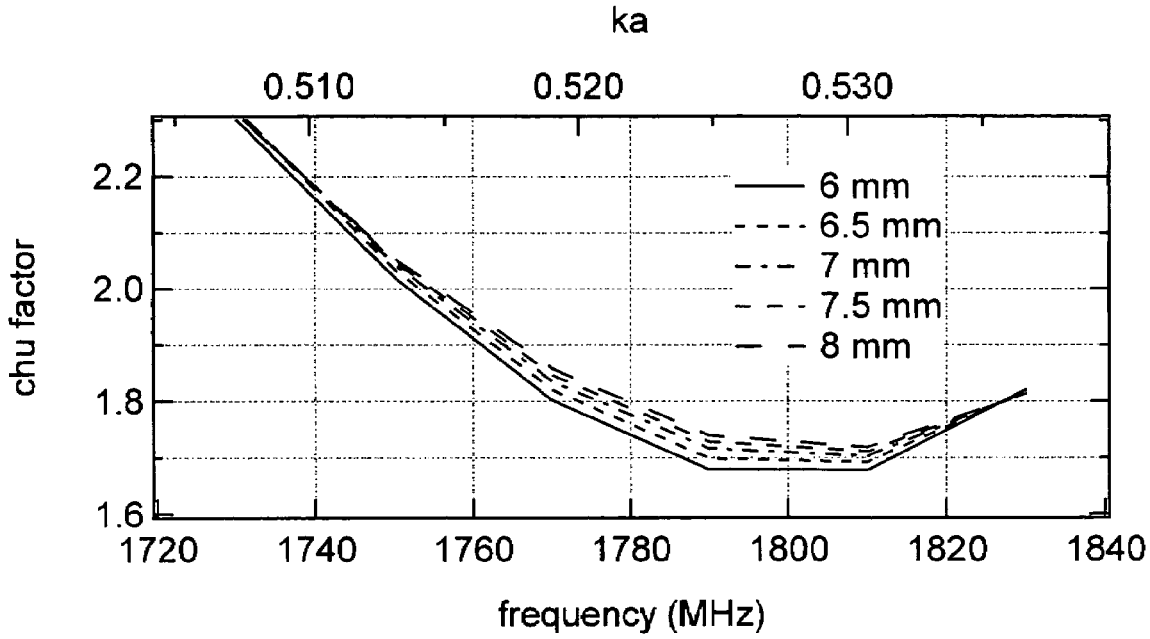
FIG. 8B provides a graph of return loss vs. frequency for the volumetric antenna embodiment of FIG. 7
Figure 8C:
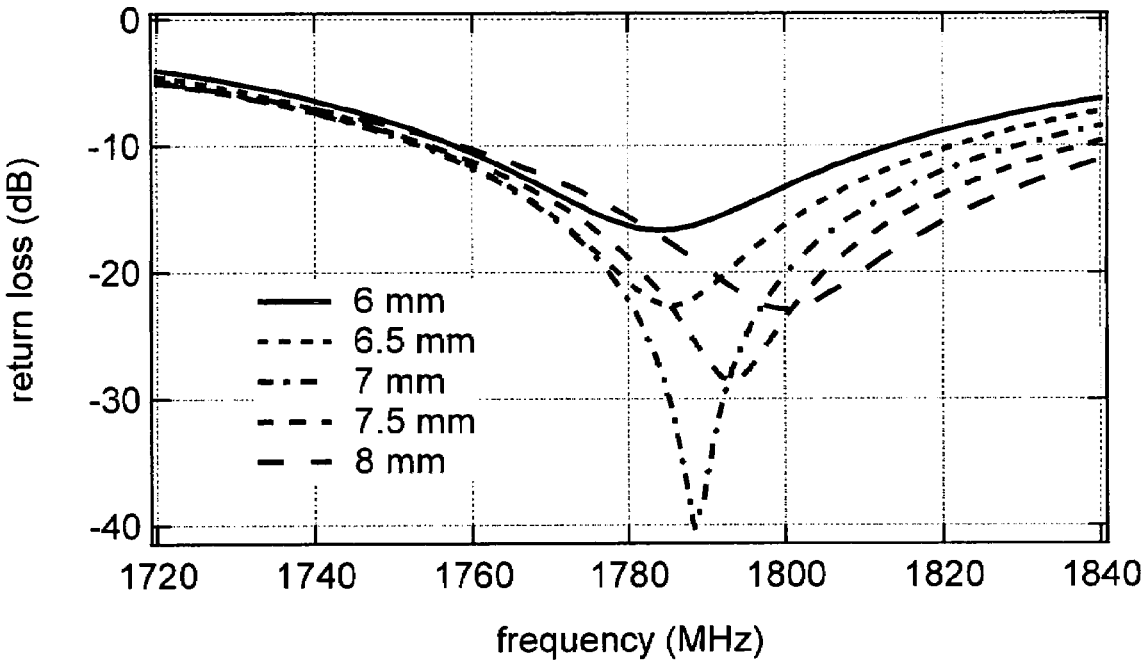
FIG. 8C provides a graph of chu factor vs. frequency for the volumetric antenna embodiment of FIG. 7.

Simulation studies have been carried out by the inventor for this volumetric antenna embodiment and the results are shown in FIGS. 8A, B & C. The simulated volumetric antenna has a ring radius of 14 mm, gap size of 6.5 mm and a trace width of 1 mm. The antenna is designed for a 100 ohm drive impedance, and the transmission line is defined by two 1 mm lines separated by a 0.13 mm gap. In order to achieve a good impedance match, the resistance of the antenna must be close to 100 ohms at the frequency where the reactance goes to zero. As will be seen from the impedance curves of FIG. 8A, this impedance match criteria between the resonator and the transmission line is obtained by varying the length of the stub extending from the end of the transmission line, where the stub length of 7 mm achieves the best impedance match. From FIG. 8C, it can be seen that, based on the design simulations, the depicted volumetric antenna will have a Chu factor of 1.7 at ka=0.525, clearly demonstrating the outstanding performance achievable in even the simplest of the volumetric designs.

As in the case of the planar two-arm antenna embodiment, the transmission line for the volumetric antenna embodiment excites the collective resonant mode of the entire structure. Currents are therefore induced in all four resonator arms, despite the fact that electrical connections are made to only two of the arms. This feature of the antenna design is particularly important from a fabrication standpoint. The construction of the antenna is relative simple: the two planar pieces of the antenna shown in FIG. 7A (the feed piece and the orthogonal piece) are combined simply by machining appropriate grooves in the PCB structures along the center axis of the resonators (without severing the transmission line in the feed piece). The two pieces are then slid together and secured using glue or non-conductive low-loss brackets. No electrical connection between the two pieces is required for the antenna to work effectively.

The above exemplary antenna embodiments illustrate one possible methodological approach to interfacing a transmission line structure to the resonators of the invention in order to form the antenna. Other approaches will be apparent to those skilled in the art of the invention and are intended to be included with the scope of the invention as described and claimed herein. For example, if one wished to drive the antenna using an unbalanced transmission line without the use of a balun, this could be done by using a half-sphere structure placed over a ground plane, with one or more of the arms of the resonator (but not necessarily all of arms) electrically connected to a driving source connected through the ground plane (for example, a coaxial feed structure). This approach has the advantage that the physical size of the antenna would be half that in the exemplary embodiments shown above, due to the presence of the ground plane. Transmission line feeds other than those described here, whether balanced or unbalanced, may also be utilized. The general procedure in designing the transmission line feed involves finding a geometry by which the transmission line mode can efficiently excite the resonant mode of the resonator. Some aspect of the feed geometry must then be varied in order to insure that the radiation resistance matches the transmission line impedance at a frequency of zero reactance in the antenna. This was done in the described exemplary two-arm antenna by varying the gap in the resonator structure at the point where the feed line enters the resonator, and it was done in the exemplary four-arm antenna by varying the length of the shorted coupling stub. It is generally desirable that the method utilized to insure an impedance match does not degrade the bandwidth performance of the antenna relative to that which is observed in the isolated resonators of the same electrical size. The described exemplary antenna embodiments satisfy this criterion. Alternatively, other techniques well known to those skilled in the art can be applied here—the T-match and gamma match techniques being two other examples. In another example, one or more lumped circuit elements (inductors or capacitors) can be placed in a series or parallel configuration along the transmission line feed to create optimal impedance matching, where the particular location, configuration, and values of the elements can be determined using techniques well known to those skilled in the art, for example through the use of Smith charts. This sort of approach allows for increased flexibility in choosing the exact frequency at which the antenna achieves the optimal match, and it is recognized that the best bandwidth performance is obtained by designing the antenna to operate at the frequencies with the lowest values of the Chu factor.

The exemplary antenna embodiments described above utilize printed circuit board implementations, where the conductor patterns are printed on thin substrates. This is a convenient implementation at frequencies where the antenna size is physically small (at frequencies>1 GHz, for example), but becomes less convenient for lower frequency antennas (100s of MHz or lower), due to the large physical size of the structures. At the lower frequency ranges, the implementation of these antennas would more likely consist of free-standing wire structures that have been bent into the appropriate shapes (or sheet-metal implementations punched out into the appropriate shapes). The general process for designing antennas for such lower-frequency embodiments is identical to that described above. While it is understood that the presence of substrates with a particular thickness and dielectric constant affects the various design parameters required to achieve the desired frequency of operation and impedance matched condition, it should also understood that the presence of such substrates is not required to achieve the exemplary performance characteristics illustrated here.

Although the resonator embodiments described herein are for resonators constructed as spheres, it should be understood that these design principals can also be applied to embodiments that are not spherical in nature (for example, ellipsoids). This may be necessary for some applications, as the aspect ratio, or shape, of the antenna may be constrained by factors not related to the antenna design (e.g., availability of space, restrictions on height, etc. in the environment in which the antenna is to be deployed). It should be further understood that the spherical shape represents the ideal, solution for the single resonance antenna. However, engineering constraints may dictate tradeoffs in bandwidth performance in exchange for having the antenna assume a particular shape or aspect ratio. Resonators of the type illustrated in FIG. 1 that are designed to be ellipsoids, rather than spheres, for example, may provide bandwidth performance that is exemplary for their aspect ratio. The two-arm planar antenna embodiment illustrated above is an example of an embodiment that is not spherical (rather it is planar), but which nevertheless was designed according to the principals described here.

All of the embodiments described herein are for resonators and antennas that are based upon a single resonance structure. It should be understood, however, that the inventive approach can also be expanded to the case of multiple resonance structures. By utilizing multiple resonances, it is possible to exceed the bandwidth performance achievable in single resonance structures—a principal that has been applied extensively in the field of microstrip antennas. By starting with single resonance structures that are optimized for bandwidth performance, it can be expected that the multiple resonance antennas formed from these single resonance building blocks will also demonstrate exemplary bandwidth performance. The planar resonator embodiment illustrated in FIG. 1 is well suited to multiple resonance implementations—for example, a double resonance structure formed by making a six- or eight-arm resonator where half of the arms had one radius, and the other half of the arms had a different radius.

Herein, the inventor has disclosed a new antenna for use in applications requiring electrically small antennas that achieves improved bandwidth over antennas of the art by arraying multiple non-interconnected resonator structures and then forming the antenna by connecting a transmission line to only one or two of those structures.

Numerous modifications and alternative embodiments of the invention will be apparent to those skilled in the art in view of the foregoing description. In particular, it should be understood that, while the invention has been generally described in terms of a physical structure that is equivalent to an electromagnetic sphere, the principles of the invention will equally apply for other aspect ratios and shape constraints for the antenna structure.

Accordingly, this description is to be construed as illustrative only and is for the purpose of teaching those skilled in the art the best mode of carrying out the invention and is not intended to illustrate all possible forms thereof. It is also understood that the words used are words of description, rather that limitation, and that details of the structure may be varied substantially without departing from the spirit of the invention, and that the exclusive use of all modifications which come within the scope of the appended claims is reserved.

What is claimed is:

1. An antenna, comprising an axially symmetric cluster of two or more open rings electromagnetically coupled to a transmission line, wherein a feed point is incorporated within at least one of the open rings, and the transmission line is directly coupled to said ring at the feed point.

2. The antenna of claim 1, wherein the antenna has an operating frequency range and at least one resonant frequency within that range associated with a free-space wavelength lambda, and the cluster has a maximum spatial dimension 2*a* such that $$\frac{2\pi a}{\lambda}$$

is less than 0.65.

3. The antenna of claim 1, comprising two or more coplanar pairs of said open rings arranged in respective planes that intersect in a common axis such that the rings of each pair are equidistant from a common axis.

4. The antenna of claim 1, wherein the rings are semicircular.

5. The antenna of claim 1, wherein the rings are semielliptical.

6. The antenna of claim 1, wherein:

the resonator has at least one resonance with a quality factor Q, a resonant frequency, and a free-space wavelength λ corresponding to said frequency;

the resonator has a maximum spatial dimension 2*a*, expressible as a dimensionless parameter A defined by $$A = \frac{2\pi a}{\lambda};$$

the resonator has a set of dimensional parameters comprising a diameter, a trace width, and a gap size for each ring and a separation distance for each pair; and the number of pairs and the dimensional parameters are selected such that A is no greater than 0.6 and Q is no greater than $$2.5 \times \left[\frac{1}{A^3} + \frac{1}{A}\right].$$

7. The antenna of claim 6, wherein the dimensional parameters are selected in respect to a dielectric constant of substrates supporting the rings.

8. The antenna of claim 6, comprising two or more coplanar pairs of said open rings arranged in respective planes that intersect in a common axis wherein the number of pairs and the dimensional parameters are selected such that Q is no greater than $$1.7 \times \left[\frac{1}{A^3} + \frac{1}{A}\right].$$

9. The antenna of claim 1, comprising two or more coplanar pairs of said open rings arranged in respective planes that intersect in a common axis wherein at least one pair has rings that differ in at least one spatial dimension partially determinative of resonant frequency.

10. The antenna of claim 9, wherein the spatial dimension is gap size.

11. The antenna of claim 9, wherein the spatial dimension is trace width.

12. The antenna of claim 9, wherein the spatial dimension is ring diameter.

13. The antenna of claim 1, comprising two or more coplanar pairs of said open rings arranged in respective planes that intersect in a common axis, wherein at least one pair is fed by a transmission line that makes electrical contact with one ring, but not the other ring, of said pair.

14. The antenna of claim 1, comprising two coplanar pairs of said open rings oriented, respectively, in mutually orthogonal planes, wherein the transmission line makes electrical contact with both rings of one pair, but no rings of the other pair.

15. The antenna of claim 1, comprising two or more coplanar pairs of said open rings arranged in respective planes that intersect in a common axis, wherein the transmission line is conformed near the rings as a parallel pair of strip conductors penetrating one ring of a pair and having a shorted end situated in the interior of the other ring of the pair.

16. Apparatus comprising a radiofrequency resonator, wherein: the resonator comprises a plurality of rings; each said ring is opened by a gap; the rings are arranged symmetrically about an axis coplanar with each of the rings; each ring is oriented with its gap facing away from the axis; and the rings are separated from the axis by a separation distance small enough to permit mutual electromagnetic coupling among the rings at an operating frequency.

17. Apparatus of claim 16, wherein the rings are semicircular.

18. Apparatus of claim 16, having a maximum spatial dimension not greater than $1/(2\pi)$ times an operating wavelength, wherein the operating wavelength is the free-space wavelength corresponding to a resonant frequency.

19. Apparatus of claim 16 conformed as an antenna by further comprising a transmission line.

* * * * *